United States Patent [19]

Fehrs

[11] 3,957,192

[45] May 18, 1976

[54] FASTENER-DRIVING TOOL

[75] Inventor: Hellmuth Fehrs, Hamburg, Germany

[73] Assignee: Joh. Friedrich Behrens Metallwaren-Fabrik, Ahrensburg, Germany

[22] Filed: Sept. 26, 1974

[21] Appl. No.: 509,433

[30] Foreign Application Priority Data

Nov. 2, 1973 Germany ..... 2354740

[52] U.S. Cl. ..... 227/123

[51] Int. Cl.[2] ..... B25C 5/06

[58] Field of Search ..... 227/123

[56] References Cited

UNITED STATES PATENTS 2,714,209 8/1955 Lindstrom ..... 227/123

3,273,777 9/1966 Juilfs et al ..... 227/123

FOREIGN PATENTS OR APPLICATIONS 300,042 7/1954 Switzerland ..... 227/123

*Primary Examiner*—Granville Y. Custer, Jr.
*Attorney, Agent, or Firm*—Beaman & Beaman

[57] ABSTRACT

A fastener-driving tool has a magazine from which the fasteners are fed to a discharge chute. The wall of the discharge chute opposite to the outlet of the magazine is movable between two positions in one of which it allows fasteners to be removed from the discharge chute. Movement of the wall, which is formed in two separable portions, is effected in a plane at right angles to the direction in which the fasteners are fed within the magazine.

8 Claims, 5 Drawing Figures

FASTENER-DRIVING TOOL

BACKGROUND OF THE INVENTION

1. Field of the Invention

This invention relates to a fastener-driving tool with a magazine for fasteners, such as U-shaped staples, nails or the like, and a discharge chute, the wall of which, opposite to the outlet of the magazine, is movable from a position closing the discharge chute to a position opening it and vice versa.

2. Description of the Prior Art

With industrial staple or nail-driving tools, which are mainly compressed-air-operated, of the kind described above, frequent interruptions occur because the staples or other fasteners in the discharge chute clog or jam during the driving-in process, driving in of the fasteners being effected by means of a compressed-air-operated piston. One reason for this is that there are some staples which have already been deformed and which cannot be correctly guided out of the discharge chute, and another reason is that there is often unsatisfactory guidance of the staples. Allowance is therefore made for this contingency, and interruptions in working of this kind can normally be quickly and easily overcome.

U.S. Pat. No. 2,985,139 shows a tool in which the wall opposite to the outlet of the magazine includes a flap, which can be swung sideways away from the discharge chute so that the latter is accessible and the removal of jammed fasteners is facilitated. The flap is held in position forming part of the discharge chute with the help of a relatively weak leaf spring. The disadvantages of this arrangement are that, either accurate guidance of the fasteners in the discharge chute will suffer if the spring is too weak, since the flap will swing even with a small force and no longer contribute to precise guidance, or, in order to overcome this disadvantage, the spring must be made so strong that the flap can only be opened by hand by the operator first removing the spring.

Moreover, a fastener-driving tool is shown in German Pat. No. 1,302,136 in which, as with the known tool described above, the wall opposite the outlet of the magazine has been developed as a hinged wall member. This wall member is kept in its closed position with the help of a locking device, which allows the wall member to pivot into an open position under the action of a particular operating force in the direction of feed. By means of this design measure any clogging of the fastener means should be prevented. In practice it has now been shown that the flap mechanism is often operated when not desired, which leads to undesired interruption to the work flow. The insertion of a particular control system, whereby operation of the locking device is only released in the case of an interruption, proves to be impractical. Reliable operation is made even more difficult by changes in the moving components resulting from wear.

Finally, a fastener-driving tool is shown in German Pat. No. 1,171,356 in which the rear wall of the discharge chute is bounded by the base plate of the magazine, which has been produced as an unloader. The base plate is held in its closed position with a resilient fixing element. In smaller machines, with a relatively small driving force, this solution has proved sufficient to overcome the clogged fasteners. However, in machines with a relatively high driving force, efficient working is no longer possible. The power derived from the driving process causes yielding or even opening of the cover plate which moves relative to the base plate of the discharge chute. Through this yielding the feed passage for the fasteners gets bigger and as a result guided passage of the fasteners is more difficult. There is therefore a greater tendency for the fasteners to become multilated or jammed.

The invention therefore has as its object the provision of a fastener-driving tool which guarantees a precise and almost interruption-free passage for the fasteners in the discharge chute and at the same time facilitates rapid removal of clogged or jammed fasteners.

SUMMARY OF THE INVENTION

A fastener-driving tool in accordance with the invention has a movable wall which is movable in a plane extending transversely to both the outlet of the magazine and the direction of movement of the fasteners within the discharge chute.

The invention is based on an appreciation of the fact that, on the one hand, a wall member forming part of the discharge chute must be removable if the discharge chute is to be accessible for the purpose of removing jammed fasteners and that, on the other hand, the reaction developed within the discharge chute — even during jamming of the fasteners — cannot act in such manner as to cause the movable wall member to be displaced into the open position. For this reason it is the part of the wall situated opposite the outlet of the magazine feed that is movable and this wall is so arranged that the reaction caused by driving-in and by jamming of fasteners in the discharge chute does not lead to displacement of the wall member.

The movable wall preferably comprises two coplanar wall members which, in the open or released position provide a space between them through which the discharge chute is accessible. Because two wall members are provided, each need only be pushed through a relatively small distance, in order to provide, in the released position, a sufficiently wide gap and therefore easy access to the discharge chute.

The movable wall or the movable wall members are secured and arranged to move in the appropriate way to give the desired effect. In a preferred embodiment, upper portions of the wall members are pivoted for movement each about an axis perpendicular to the discharge chute and parallel to the magazine feed path. In order to open the discharge chute the free ends of the wall members need only be forced apart by a certain amount.

Guide means are desirably provided for the wall members and are located beneath pivot axes, whereby the wall members are guided positively in a plane perpendicular to the magazine feed path and the path of movement of fasteners in the discharge chute. The guide means can be of any suitable form. Preferably, however each wall member is formed with an arcuate slot However, its centre of curvature lying on the pivot axis, through which a closely fitting screw is passed so that the head of the screw overlies the boundaries of the slot and forms a guide for the wall member.

Preferably the wall members extend upwardly above the pivot axes and, between the upper ends of the members, a compression spring is disposed which urges the wall members into their closed positions. Upon urging the upper ends of the two wall members together, the lower ends are forced apart to obtain access to the discharge chute. Stop surfaces at the upper ends of the wall members limit the degree of pivotal movement of the wall members.

DESCRIPTION OF THE PREFERRED EMBODIMENT.

Figure 1:
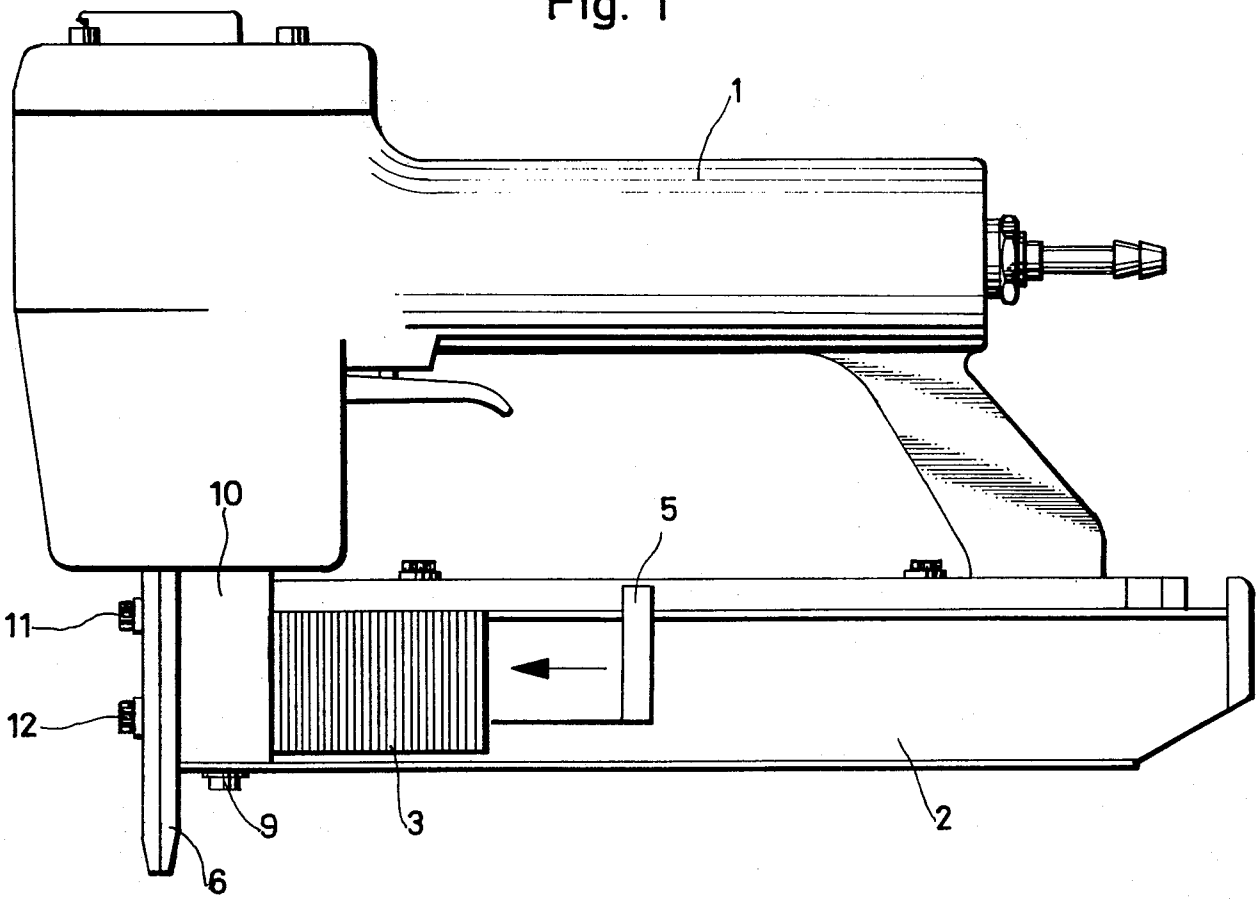
FIG. 1 is a diagrammatic side view of a compressed-air-operated fastener-driving tool with a magazine.
Figure 4:
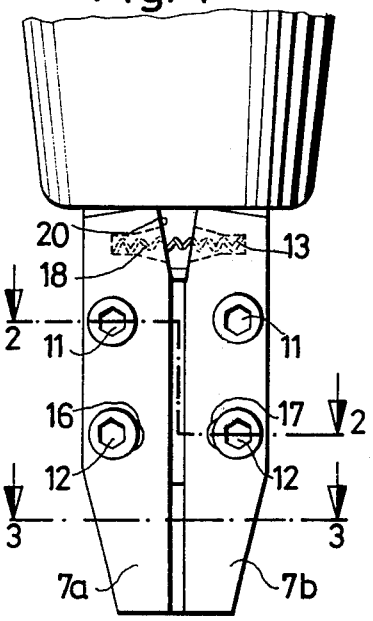
FIG. 4 is a front view of the discharge chute of the compressed-air-operated tool shown in FIG. 1.
Figure 5:
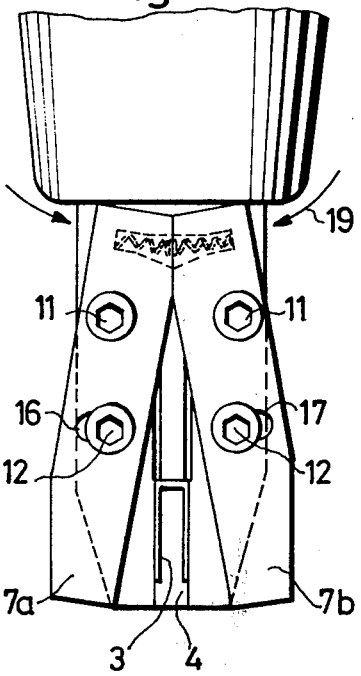
FIG. 5 is a view corresponding to FIG. 4, but in which the discharge chute is open.
Figure 2:
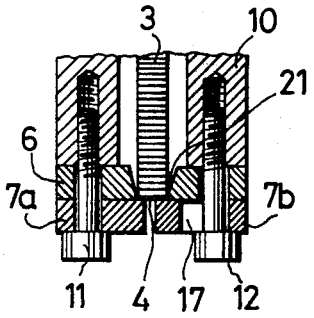
FIG. 2 is a sectional view of part of the tool taken along the line 2—2 in FIG. 4.

The compressed-air-operated fastener-driving tool shown in FIG. 1 consists of a casing 1 and a magazine 2 for the reception and feeding of fasteners, in the present case U-shaped staples, which are guided into a discharge chute 4 under the action of a channelsection sliding bolt 5. The sliding bolt is under the control of a tension spring not shown in the drawings. The discharge chute is formed by a rectangular channel 8, which is formed in a rear wall plate 6 and two front cover plates 7*a* and 7*b*, which lie parallel to flat guide surfaces 14, 15 of the rear wall plate 6. At its front end 10 the magazine 2 is positively attached to the casing 1 by means of a screw 9. Screws 11 attach the cover plates 7*a* and 7*b* and the rear wall plate 6 to said front end portion 10 (FIGS. 2, 4 and 5). In addition the screws 11 form pivot mountings for plates 7*a* and 7*b* as can be seen from FIG. 5.

In addition, plates 7*a* and 7*b* are formed with slots 16, 17 at a lower level than the screws 11, through which screws 12 project and these are screwed into the front end portion 10 (see FIG. 2). The undersides of the heads of the screws 12 provide guidance for the plates 7*a* and 7*b* and prevent unwanted yielding and outward bending of the plates 7*a* and 7*b* which would lead to a corresponding increase in the size of the discharge chute 4 and reduce accurate guidance of the fasteners. The plates 7*a* and 7*b* extend upwardly above the screws 11 and are formed with bores 18, shown in dotted lines in FIG. 4, in which a compression spring 13 is seated, to retain the plates 7*a* and 7*b* in their closed positions shown in FIG. 4. A force in the upper area acting on the plates 7*a* and 7*b* in the direction of the arrows 19 serves to cause the plates 7*a* and 7*b* to swing into open positions as shown in FIG. 5, so that any fastener which might have become jammed in the output chute can be removed. Stop surfaces 20 on the plates 7*a* and 7*b* limit the degree of swinging of the plates.

Figure 3:
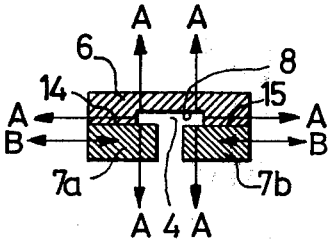
FIG. 3 is a sectional view of part of the tool along the line 3—3 in FIG. 4.

During operation, the fasteners 3 are pushed, under the action of the sliding bolt 5, against one another and through an opening 21 in the rear wall 6 of the discharge chute 4. The configurations and the modes of movement of the individual parts have been chosen so that the reaction developed within the output chute 4 in the driving-in process, as shown by the arrows A in FIG. 3, cannot operate to displace the plates 7*a* and 7*b* and, as a result, expansion of the discharge passage for the fasteners 3 is not possible. The fasteners are guided much more accurately, which in itself causes jamming to be eliminated to a very great extent. If in spite of this, jamming should occur then the plates 7*a* and 7*b* are, as shown in FIG. 5, forced apart in the direction of the arrows B in FIG. 3 so that the discharge chute 4 is easily accessible and the obstruction can be removed.

What is claimed is:

1. A fastener-driving tool having a magazine to receive fasteners having a fastener outlet and a discharge chute communicating with said outlet receiving the fasteners fed from the magazine outlet, said discharge chute having a wall located opposite the outlet of the magazine comprising two wall members each movable between a position restricting the discharge chute and a fastener release position, said wall members defining a gap between them when moved to said release position through which said discharge chute is accessible, and wall support means supporting said wall members for movement only in a plane perpendicular to the direction of feed of the fasteners within the magazine and perpendicular to the direction of movement of the fasteners in said discharge chute.

2. A tool according to claim 1, wherein a spring is interposed between said wall members biasing said wall members toward said position restricting said discharge chute.

3. A tool according to claim 1, wherein said wall support means comprise pivots having axes perpendicular to the direction of movement of the fasteners in the discharge chute supporting said wall members.

4. A tool according to claim 3, wherein guide means are mounted beneath the pivot axes engaging said wall members and the wall members are positively restrained thereby against movement other than in said plane.

5. A tool according to claim 4, wherein said guide means include a slot disposed beneath the associated pivot axis through which slot a fastener fastenr is passed and the head of the fastener covers the width of the slot so that the undersurface of the head acts as a guide for the outer surface of the associated wall member.

6. A tool according to claim 3, wherein a compression spring is interposed between said wall members above the pivot axes biasing said wall members toward said position restricting said discharge chute.

7. A tool according to claim 6, wherein the compression spring is seated in bores formed in said wall members.

8. A tool according to claim 3, wherein said wall members include end portions above said pivots and said end portions of said wall members include abutting surfaces forming stops which limit the extent of pivotal movement of the wall members in the release position.

* * * * *

UNITED STATES PATENT OFFICE

CERTIFICATE OF CORRECTION

Patent No. 3,957,192 Dated May 18, 1976

Inventor(s) Hellmuth Fehrs

It is certified that error appears in the above-identified patent and that said Letters Patent are hereby corrected as shown below:

Column 4, line 43, before "fastener" insert - headed -.

Column 4, line 43, cancel "fastenr".

Signed and Sealed this

Fourteenth Day of September 1976

[SEAL]

*Attest:*

RUTH C. MASON
*Attesting Officer*

C. MARSHALL DANN
*Commissioner of Patents and Trademarks*